US006604717B2

(12) United States Patent
Stanfield

(10) Patent No.: US 6,604,717 B2
(45) Date of Patent: Aug. 12, 2003

(54) BAG HOLDER

(76) Inventor: McCoy J. Stanfield, P.O. Box 1083, Durham, NC (US) 27702

( * ) Notice: Subject to any disclaimer, the term of this patent is extended or adjusted under 35 U.S.C. 154(b) by 0 days.

(21) Appl. No.: 10/252,459

(22) Filed: Sep. 23, 2002

(65) Prior Publication Data

US 2003/0019981 A1 Jan. 30, 2003

Related U.S. Application Data

(63) Continuation of application No. 09/713,365, filed on Nov. 15, 2000.

(51) Int. Cl.[7] ..... B65B 67/04

(52) U.S. Cl. ..... 248/99; 248/101; 294/1.4; 294/1.1

(58) Field of Search ..... 248/95, 97, 99, 248/101; 294/1.1, 55, 1.4, 1.5; D34/6; 15/257.1, 257.4, 257.6, 27

(56) References Cited

U.S. PATENT DOCUMENTS

| | | | | | |
|---|---|---|---|---|---|
| 1,353,330 | A | * | 9/1920 | Erickson | 248/101 |
| 3,614,041 | A | * | 10/1971 | Koger | 248/97 |
| 3,796,402 | A | * | 3/1974 | Trotta | 248/97 |
| 3,866,872 | A | * | 2/1975 | Burgess | 248/97 |
| 3,916,962 | A | * | 11/1975 | Stolt | 141/108 |
| 3,942,832 | A | * | 3/1976 | Haas, Jr. | 294/55 |
| 4,157,801 | A | * | 6/1979 | Elmer | 248/97 |
| 4,358,083 | A | * | 11/1982 | Haubrich | 248/545 |
| 4,705,310 | A | * | 11/1987 | Scripter | 294/1.4 |
| 4,723,803 | A | * | 2/1988 | Sapp | 294/55 |
| 4,738,478 | A | * | 4/1988 | Bean, Jr. | 294/55 |
| 4,805,858 | A | * | 2/1989 | Taylor | 248/99 |
| 4,934,637 | A | * | 6/1990 | Guerrera | 248/100 |
| 4,940,201 | A | | 7/1990 | Kurth | 248/101 |
| 5,016,844 | A | | 5/1991 | Garvin | 248/97 |
| 5,193,770 | A | * | 3/1993 | Kildare | 248/97 |
| 5,217,271 | A | * | 6/1993 | Moe | 294/1.1 |
| 5,718,400 | A | | 2/1998 | Dwy | 248/99 |
| 6,086,022 | A | | 7/2000 | Dalton | 248/99 |
| 6,386,606 | B1 | * | 5/2002 | Marshall | 15/257.4 |
| D460,234 | S | * | 7/2002 | King | D34/6 |
| 6,416,023 | B1 | * | 7/2002 | Satsky | 248/99 |
| 6,471,267 | B2 | * | 10/2002 | Asazuma | 294/1.5 |
| 6,517,034 | B1 | * | 2/2003 | Kinchen | 248/99 |
| 6,520,554 | B2 | * | 2/2003 | Ditzik | 294/1.1 |
| 2003/0019981 | A1 | * | 1/2003 | Stanfield | 248/101 |

FOREIGN PATENT DOCUMENTS

DE 2197288 A * 5/1988

* cited by examiner

*Primary Examiner*—Kimberly Wood
*Assistant Examiner*—Naschica S. Morrison
(74) *Attorney, Agent, or Firm*—Olive & Olive, P.A.

(57) ABSTRACT

A bag holder is provided in the form of a hoop which receives a bag and holds the top of the bag open at all times, thus allowing a person to deposit trash or other articles therein without having to repeatedly open the top of the bag. The bag is placed within the hoop with the top lip of the bag draped over the hoop rim, and the bag is held in place by a number of spring clips.

3 Claims, 1 Drawing Sheet

BAG HOLDER

RELATION TO PRIOR APPLICATION

This application is a continuation of patent application Ser. No. 09/713,365 filed Nov. 15, 2000 under the same title.

BACKGROUND OF THE INVENTION

1. Field of the Invention

The invention relates generally to the field of bag holders, and, more particularly, relates to portable bag holders which maintain the bag in an open condition so that items can be easily deposited in the bag.

2. Description of Related Art

Bag holders are known to exist which hold a bag in a stationary, open position. The simplest of these would be a trash can which receives a bag as a liner in an attempt to keep the internal walls of the trash can clean to reduce the frequency of cleaning needed. This, however, is not the purpose or structure of the present invention. Also, holders are known which comprise wire frames which receive a bag and hold it open for leaf disposal purposes.

U.S. Pat. Nos. 6,086,022; 5,718,400; 5,016,844; and 4,940,201 are representative of holders for bags which are known to exist.

U.S. Pat. No. 6,086,022 provides a "Shoulder-Mounted Trash Bag Holder" which utilizes an interlocking dual ring and a shoulder strap for transport of a bag.

U.S. Pat. No. 5,718,400 provides a "Trash Bag Holder With Handle" which employs a frame and handle member for transport of a bag.

U.S. Pat. No. 4,940,201 provides a "Yard Plastic Bag Holder" utilizing a vertical bag support post which is driven into the ground to hold the bag stationary in a vertical position.

U.S. Pat. No. 5,016,844 provides an "Open Top Trash Bag Holder" having ground engaging legs for supporting the trash bag at a selected location.

No solution is known to provide a simple, light-weight device which holds a bag open so as to be carried around by a person while being held on or against the person's hip by one of the person's hands, thus allowing the person to work with his free hand.

Therefore, it is an object of the present invention to provide a bag holder which receives a bag in a manner such that the top of the bag is held in an open condition at all times.

Another object of the present invention is to provide a bag holder which allows a person to have at least one hand free at all times to pick up material, litter, etc. to be deposited in the bag.

Additional advantages, features and objects of the present invention will become apparent through the description which follows, and is particularly pointed out in the appended claims.

SUMMARY OF THE INVENTION

According to the present invention, a bag holder is provided in the form of a hoop which receives a bag and holds the top of the bag open. The hoop includes a handle which extends inwardly from the hoop and to which cords are attached. Each cord has several spring clips connected along its length. When a bag is placed in the hoop, the top of the bag is draped over the hoop and the clips are attached to hold the bag to the hoop at various intervals.

The person will hold the hoop with one side of the hoop resting against the person's hip or body, and the other side is held by the person's hand, thereby positioning the bag conveniently with its top open for inserting trash or the like.

BRIEF DESCRIPTION OF THE DRAWINGS

In order for the invention to become more clearly understood, it will be disclosed in greater detail with reference to the accompanying drawings, in which.

DESCRIPTION OF THE PREFERRED EMBODIMENT

Figure 1:
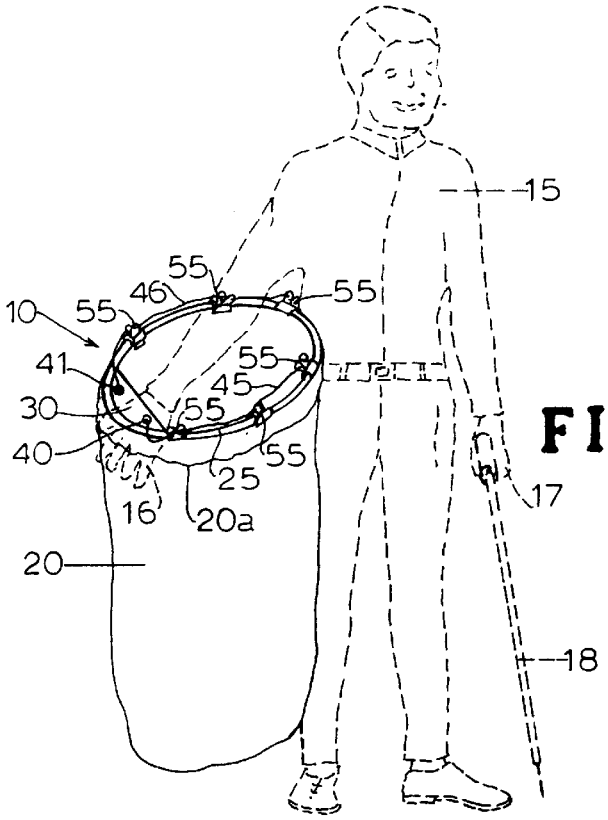
FIG. 1 is a pictorial view of the invention bag holder, with a bag being secured thereto by bag holder clips and the invention being used by a person picking up trash, the person being shown in dashed lines.

FIG. 1 illustrates the manner of use of the present invention bag holder 10, with a bag 20 mounted thereto. A grounds maintenance person 15 is illustrated in dashed lines. Bag holder 10 is comprised of a hoop 25 which, in this embodiment, is formed as a substantially circular ring of approximately 18 inches in diameter, "D", (see FIG. 2). The diameter of hoop 25 is selected so that the person's arm 16 can easily reach across hoop 25 to a handle 30.

Figure 2:
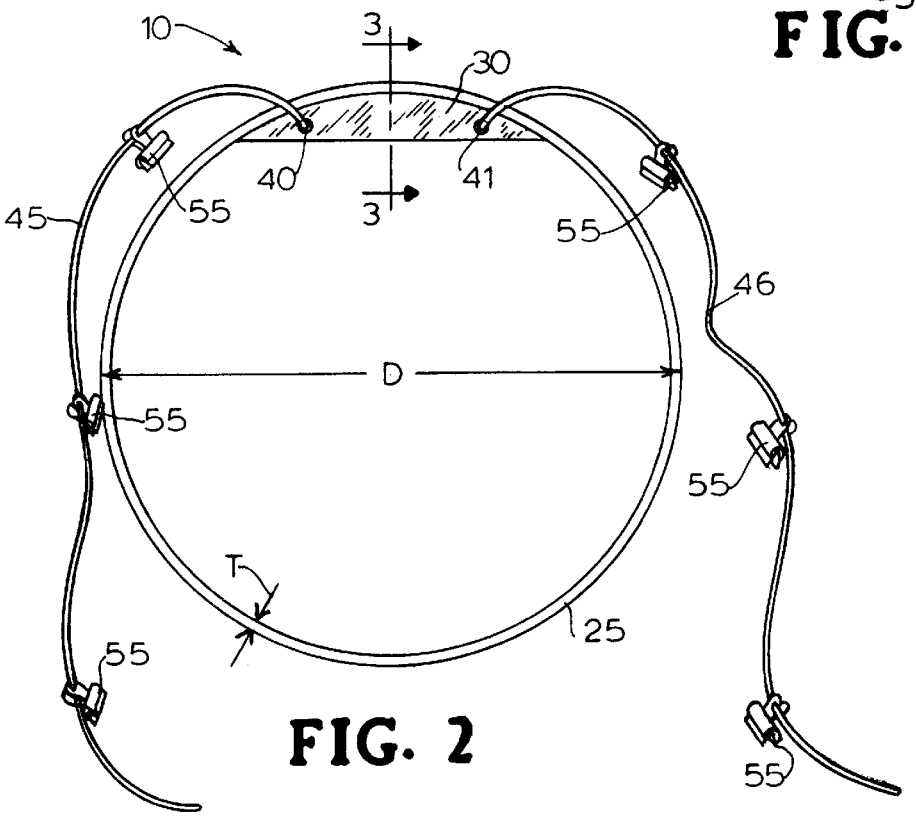
FIG. 2 is a top plan view of the invention bag holder without a bag and with the spring clips shown attached at intervals along a pair of cords.

Referring now to FIG. 2, the rim of hoop 25 is approximately 5/16 inch in thickness, "T", in the preferred embodiment. Hoop 25 is preferably formed from a lightweight material or it could alternatively be formed from a metal material for greater strength, as long as the weight thereof is not excessive. A suitable lightweight material is polyvinyl plastic resin. Hoop 25 could also be alternatively formed as a hollow tubular ring.

Handle 30 is fixedly connected to and depends from hoop 25 along a portion of the inner edge of hoop 25 to provide a thin, substantially flat member that is easily grasped by one hand 16 of person 15. Handle 30 is connected to hoop 25 by welding, screws, or other convenient means. As seen in FIG. 1, hoop 25 is held in a secure relationship resting on or against the hip of person 15 with a first hand 16 on handle 30 thereby leaving the other hand 17 free. Free hand 17 can be used to manipulate a trash pick up stick 18, or other means to pick up items for deposit in bag 20.

Figure 3:
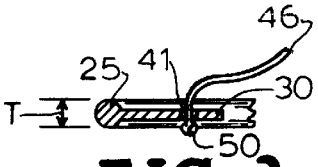
FIG. 3 is an enlarged, fragmentary detail section view showing the hoop, handle, and cord, taken substantially along line 3—3 of FIG. 2.

FIG. 2 clearly illustrates a top view of bag holder 10 of the present invention. Handle 30 receives a pair of cords 45, 46 of predetermined length, each of which is passed through a respective one of holes 40, 41 in handle 30. As more clearly seen in the enlarged, fragmentary detail section view of FIG. 3, a first end of typical cord 46 passes through respective hole 41 in handle 30. Knot 50, or other suitable means, is formed at the end of cord 46 for preventing cord 46 from being pulled through hole 41.

Cords 45, 46 are of sufficient length for each cord to reach approximately half way around the circumference of hoop 25. Cords 45, 46 are located on opposed ends of handle 30. A predetermined number (typically three per cord) of commercially available spring clips 55 are fixedly secured along the length of cords 45, 46. When not in use to secure bag 20 to hoop 25, cords 45, 46 and spring clips 55 hang from handle 30. Spring clips 55 are of sufficient size to clamp bag 20 to hoop 25 when invention bag holder 10 is in use.

Referring again to FIG. 1, in using bag holder 10, a person 15 will insert a bag 20 through the center of hoop 25 and fold a lip portion 20*a* thereof over hoop 25. Lip portion 20*a* is typically folded over hoop 25 by a length of three to ten inches. This three to ten inch lip, once bag 20 is filled and removed from hoop 25, is used to close bag 20. Bag 20 can be knotted, closed with a tie, or closed with drawstrings provided in the mouth thereof for closing of bag 20. Once bag 20 has been mounted on hoop 25 so that three to ten inches laps over hoop 25, cords 45, 46 are situated and clips 55 are utilized to clip bag 20 to hoop 25 in several separated locations (see FIG. 1).

Referring again to FIG. 1, person 15 will now hold bag holder 10 and bag 20 against his body and the other side, preferably at handle 30, in his hand 16. Such positioning will situate bag 20 conveniently with an open top for inserting trash, yard debris, or other items being collected therein. Once bag 20 is filled or the pick up job is completed, clips 55 are removed and remain suspended by cords 45, 46 from handle 30, and the top of bag 20 is then closed by conventional means.

While not shown, it is within the scope of the invention to make hoop 25 with a larger or smaller diameter so that various size bags 20 can be accommodated. Also, hoop 25, rather than being circular in shape, could be formed elliptical, rectangular, or square, as long as a conventional bag could be mounted thereon as previously described.

The above detailed description of a preferred embodiment of the bag holder invention has set forth the best mode contemplated by the inventor for carrying out the invention at the time of filing this application and is provided by way of example and not as a limitation. Accordingly, various modifications and variations, obvious to a person of ordinary skill in the art to which it pertains, are deemed to lie within the scope and spirit of the invention as set forth in the following claims.

What is claimed is:

1. A portable bag holder adapted for mounting folded edge portions surrounding the open end of a bag carried by said holder, consisting of:

a) an integral circular hoop having a circumference substantially equal to the circumference of the open end of the bag carried by said holder;

b) a handle extending inwardly from said hoop, forming an integral portion thereof and being shaped and located on said hoop in a manner enabling the handle when grasped to support said hoop on the hip of the user of said holder;

c) a pair of elongated strands extending out from said handle and substantially equal in length to one half the circumference of said hoop; and d) a plurality of manually operated clips spaced along the length of each of said strands.

2. A portable bag holder as claimed in claim 1, wherein said hoop, handle, and strands are molded of plastic.

3. A portable bag holder as claimed in claim 1, wherein said clips comprise spring-loaded metal clips.

* * * * *